US006400321B1

(12) United States Patent
Fenwick et al.

(10) Patent No.: US 6,400,321 B1
(45) Date of Patent: Jun. 4, 2002

(54) SURFACE-MOUNTABLE PATCH ANTENNA WITH COAXIAL CABLE FEED FOR WIRELESS APPLICATIONS

(75) Inventors: Stephen C. Fenwick, Mountain View; Art Astrin, Palo Alto; Thomas J. Birnbaum, Santa Cruz; Rick Mariano, Hayward; Frank Fangonilo, Milpitas, all of CA (US)

(73) Assignee: Apple Computer, Inc., Cupertino, CA (US)

( * ) Notice: Subject to any disclaimer, the term of this patent is extended or adjusted under 35 U.S.C. 154(b) by 0 days.

(21) Appl. No.: 09/617,617

(22) Filed: Jul. 17, 2000

(51) Int. Cl.[7] ..... H01Q 3/02

(52) U.S. Cl. ..... 343/700 MS; 343/702; 343/846

(58) Field of Search ..... 343/700 MS, 702, 343/846, 713, 829

(56) References Cited

U.S. PATENT DOCUMENTS 5,635,881 A * 6/1997 Romerein et al. ..... 333/101
5,790,661 A * 8/1998 Patterson ..... 379/446
5,995,048 A 11/1999 Smithgall et al. ..... 343/700
6,008,762 A 12/1999 Nghiem ..... 343/700
6,023,245 A * 2/2000 Gomez et al. ..... 343/713

* cited by examiner

*Primary Examiner*—Don Wong
*Assistant Examiner*—Hoang Nguyen
(74) *Attorney, Agent, or Firm*—Blakely, Sokoloff, Taylor & Zafman LLP

(57) ABSTRACT

The invention includes an antenna assembly. The antenna assembly includes an antenna plate that defines an interior surface. The antenna plate includes a boss that extends from the interior surface of the antenna plate and a feed point. The antenna assembly also includes a ground plate that defines an interior surface. The ground plate includes a probe channel and a boss. Both the probe channel and the boss each extends from the interior surface of the ground plate. The ground plate boss is coupled to the antenna plate boss. The antenna assembly also includes a probe feed having a ground wire coupled to the probe channel and a conductor wire coupled to the feed point.

34 Claims, 4 Drawing Sheets

SURFACE-MOUNTABLE PATCH ANTENNA WITH COAXIAL CABLE FEED FOR WIRELESS APPLICATIONS

BACKGROUND OF THE INVENTION

1. Field of the Invention

The invention may include radio wave antennas to communicate from one station to another. More particularly, the invention may include a surface-mountable microstrip patch antenna having an angled coaxial cable feed for wireless applications.

2. Background Information

An antenna may be that component of a personal communication device, a radio, a television, or a radar system that directs incoming and outgoing radio waves between free space and a transmission line. Antennas are usually metal and have a wide variety of configurations, from the whip or mastlike devices employed for radio and television broadcasting to the large parabolic reflectors used to receive satellite signals and the radio waves generated by distant astronomical objects.

One antenna configuration is known as a microstrip patch antenna. Originally developed in the 1960s for use in aerodynamic military applications, a patch antenna may be viewed as a low-profile antenna that neither disturbs an exterior aerodynamic flow nor excessively protrudes inward to disrupt the internal mechanical structure on which the antenna is supported. A microstrip patch antenna may consist of a rectangular conductor plate or "patch" that is elevated above a ground plane over a dielectric layer. The conductor plate of this planar configuration may be excited from beneath by a probe feed, such as through a round coaxial feed, to generate radio waves. A region of air may serve as the dielectric layer as well as reside above the patch as free space to allow the patch to radiate and receive radio waves.

The ground plane of a patch antenna conventionally is the chassis of the structure to which the antenna is connected. This chassis conventionally is modified so that the coaxial feed may be coupled to the chassis with a connector having a shield. The shield of the connector then is passed from inside the chassis through the connector so that the center conductor of the coaxial cable may make perpendicular contact with the patch from beneath the patch.

The problem with the conventional patch antenna is that its coaxial feed protrudes into the internal area of the mechanical structure on which the patch antenna is supported. This may require additional machining to the supporting structure as well as disrupt the internal area of the mechanical structure. Moreover, the patch antenna connector represents an extra piece whose manufacture and installation expense may represent half of the overall cost of the patch antenna. Further, employing the chassis as the ground plane may limit the applications in which the conventional patch antenna may be installed.

DETAILED DESCRIPTION OF THE INVENTION

Figure 1:
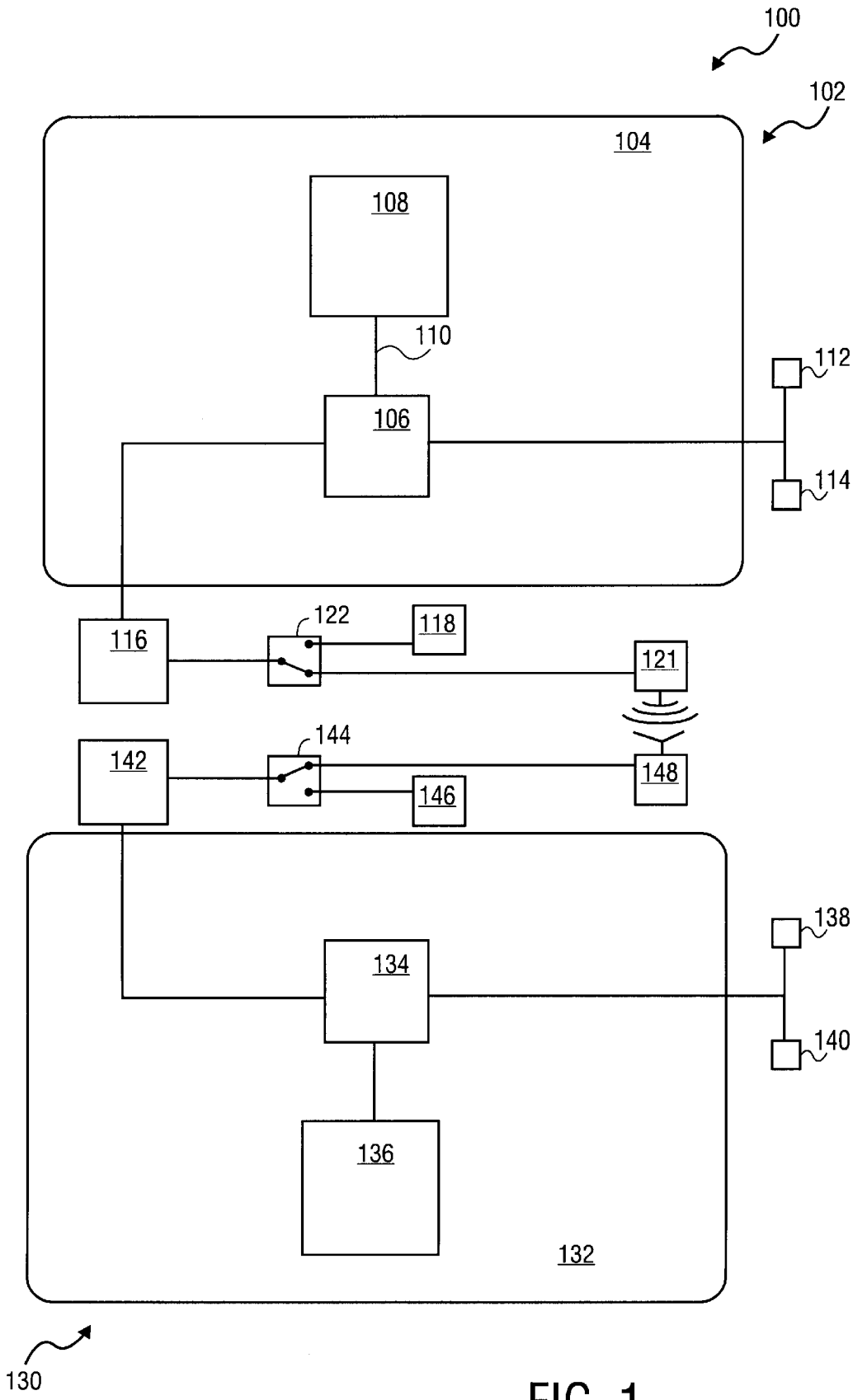
FIG. 1 is a block diagram of system 100 of the invention.

FIG. 1 is a block diagram of system 100 of the invention. System 100 may include platform 102 and platform 130, each of which may be associated with any communication system. For example, platform 102 may be associated with a desk top computer, a main frame, a radio, a television, a mobile computer, such as a laptop, a satellite system, or other electronic devices that process information.

Platform 102 may be associated with a first computer chassis and platform 130 may associated with a second computer chassis that may be located thirty meters (one hundred feet) away in the same office space. Here, platform 102 may be adapted to be in wireless communication with platform 130. The thirty meters distance of this wireless communication may be a function of the power allocated to this task such that this distance may be greater or smaller than thirty meters.

Platform 102 may include motherboard 104. Motherboard 104 may be the main board of a computer. Moreover, motherboard 104 may contain circuitry for a central processing unit, a keyboard, and a monitor as well as include slots to accept additional circuitry. Included with motherboard 104 may be chipset 106 and central processing unit (CPU) 108. Chipset 106 may be coupled to CPU 108 through front side bus (FSB) 110 so as to serve as an interface between CPU 108 and other devices. Chipset 106 may be a collection of integrated circuits designed to be used together as a core logic for some specific purpose, such as control circuitry in a personal computer. CPU 108 may be that part of platform 102 which controls all the other parts by executing software instructions.

Coupled to chipset 106 may be video card 112 and hard drive 114. Video card 112 may be a circuit board having the necessary video memory and other electronics to provide a bitmap display to a monitor. Hard drive 114 may be a disk drive used to read and write one or more rigid magnetic data storage disks (hard disks) that rotate about a central axle. Chipset 106 may also be coupled to wireless card 116.

Wireless card 116 may be a device capable of modulating a data stream from CPU 108 onto a carrier signal having a selected frequency band or demodulating a received carrier signal from its frequency into a data signal to be delivered to CPU 108. Wireless card 116 may operate in any radio frequency (RF) band (from extra low frequency (ELF) to multi-gigahertz (GHz)). This may depend on the application. Moreover, although similar in function to a fifty six kilobits per second wire-based modem, may operate at eleven megabits per second or higher. In this case, the frequency band may be 2.4 to 2.5 GHz.

Wireless card 116 may be directly coupled to an antenna.

However, there may be circumstances where one antenna is insufficient to receive wireless communications from every direction. For example, if computers within an office space communicate through a wireless network, some signals may arrive from one side of the computer enclosure whereas other signals may arrive from the opposite side of the computer enclosure. Where the internal electronics of a computer minimize or prevent transmission of a wireless communication signal through the computer enclosure to one antenna, the signals to this antenna may be thought of as fading in the field. Here, it may be necessary to have an antenna on each side of the computer enclosure so as to be assured of receiving wireless communications, irrespective of the direction of the signal.

As shown in FIG. 1, wireless card 116 may be coupled to antenna 118 and antenna 120 through diversity switch 122. Diversity switch 122 may be a device used to divert current from one conductor to another in response to a signal, such as from a CPU. For example, where wireless signals to antenna 118 fade in the field, diversity switch 122 may couple wireless card 116 to antenna 120 as shown.

Platform 130 of system 100 may have a similar or different setup as platform 102. Included with platform 130 may be motherboard 132 having chipset 134 and CPU 136. Coupled to chipset 134 may be video card 138, hard drive 140, and wireless card 142. Similar to wireless card 116, wireless card 132 may be a device capable of translating data from CPU 136 into a signal having a selected frequency band or translating a signal into data to be delivered to CPU 136. Coupled to wireless card 142 through diversity switch 144 may be antenna 146 and antenna 148. As shown in FIG. 1, antenna 120 of the invention of platform 102 may be positioned to be in wireless communication with antenna 148.

Figure 2:
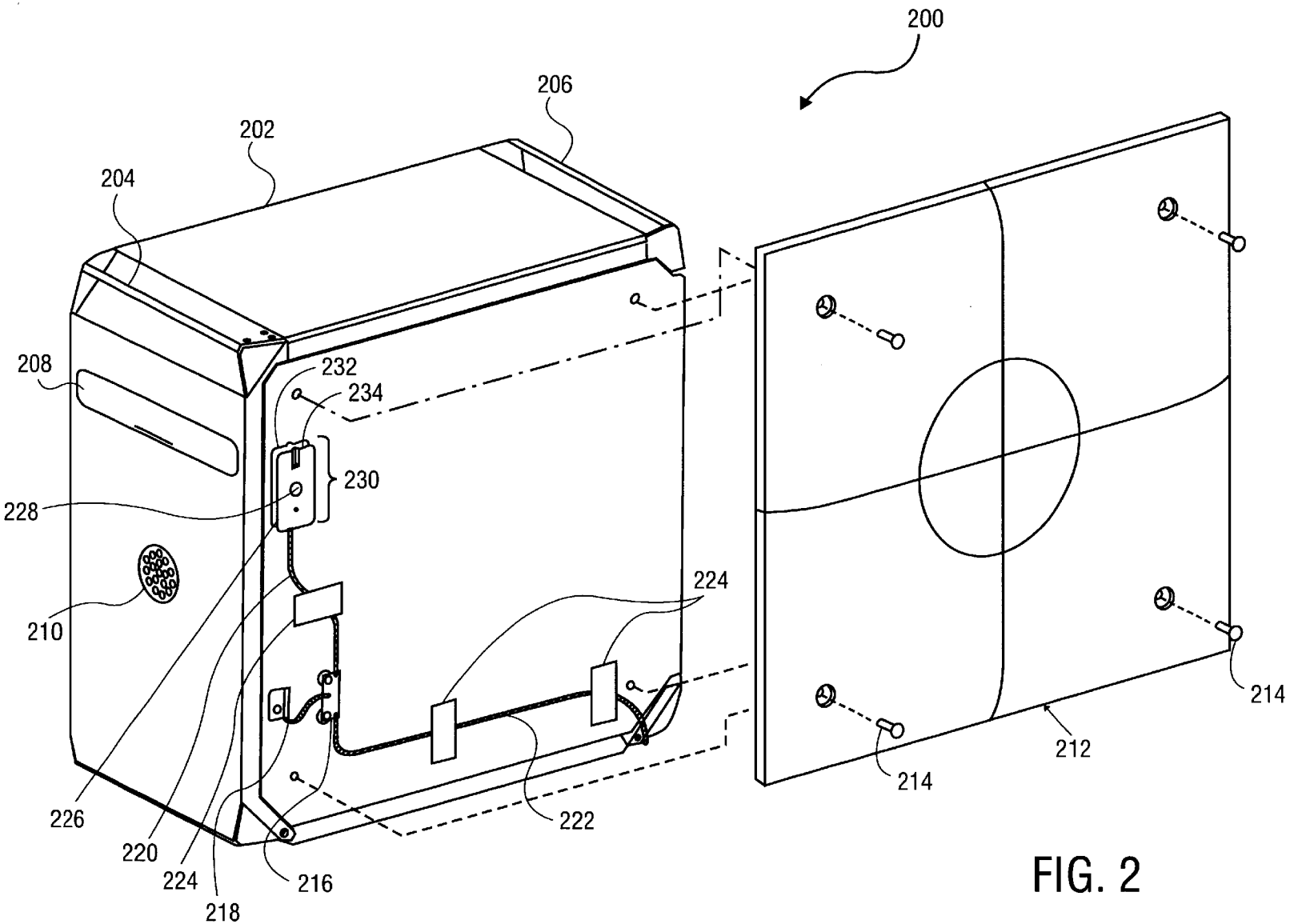
FIG. 2 illustrates structure 200 of the invention.

FIG. 2 illustrates structure 200 of the invention. Structure 200 may include chassis 202. A chassis may be the structure to which the components of a radio, television, computer, or other electronic equipment are attached. In one embodiment, chassis 202 may be the supporting structure for platform 102 of FIG. 1.

Included with chassis 202 may be front handle 204, rear handle 206, Compact Disc-Read Only Memory (CD-ROM) door 208, speaker mesh 210, and side panel 212. Front handle 204 and rear handle 206 may aid in moving structure 200. CD-ROM door 208 may open to provide access to a CD-ROM drive. Speaker mesh 210 may permit audible sounds to emanate from within chassis 202. Side panel 212 may be a facade that may be coupled to chassis 202 by screws 214 so as to protect components disposed external to chassis 202.

Coupled to chassis 202 may be diversity switch 216. Diversity switch 216 may be similar to diversity switch 122 or 144 of FIG. 1. Wire 218 may extend from diversity switch 216 towards a wireless card (not shown). Also extending from diversity switch 216 may be probe feed 220 and probe feed 222, each of which may be secured to chassis 202 by tape pieces 224. At the end of probe feed 220 may be antenna 226 and at the end of probe feed 222 may be a second antenna coupled to an opposing side of chassis 202 (not shown). Antenna 226 may be coupled to chassis 202 by screw 228, adhesive, strips of hook and loop fasteners, or other fixation devices.

Antenna 226 and probe feed 220 of FIG. 2 may form antenna assembly 230 of the invention. Antenna 226 may be thought of as a patch antenna. As a patch antenna, antenna 226 may include plate 232 and plate 234. One embodiment of plate 232 and plate 234 is discussed in connection with FIGS. 3A–3D.

Figure 3B:
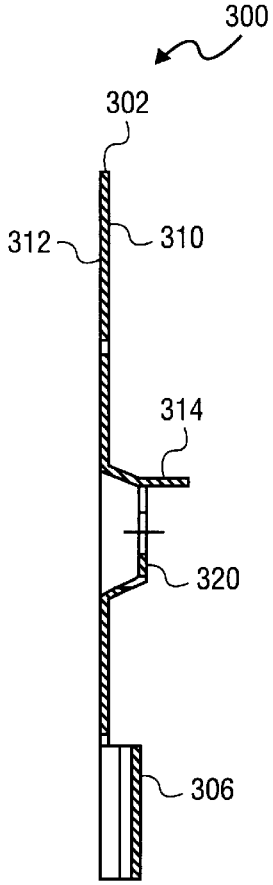
FIG. 3B illustrates a side sectional view of plate 300 generally taken off of line B—B of FIG. 3A.
Figure 3A:
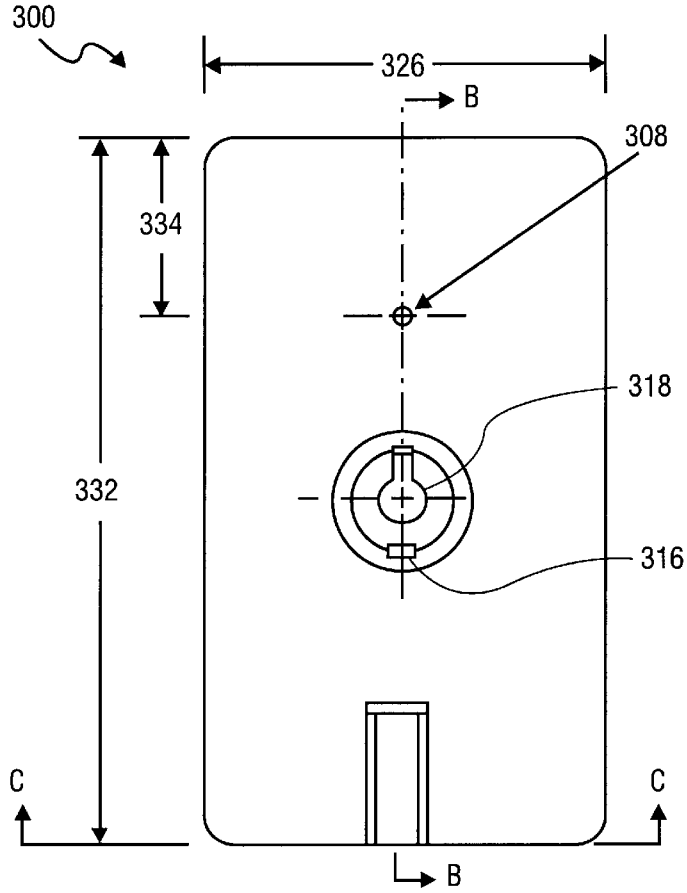
FIG. 3A illustrates a top view of plate 300.
Figure 3C:
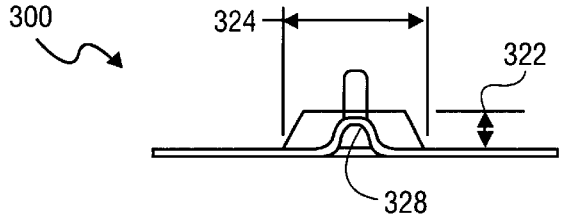
FIG. 3C illustrates a side view of plate 300 generally taken off of line C—C of FIG. 3A.
Figure 3D:
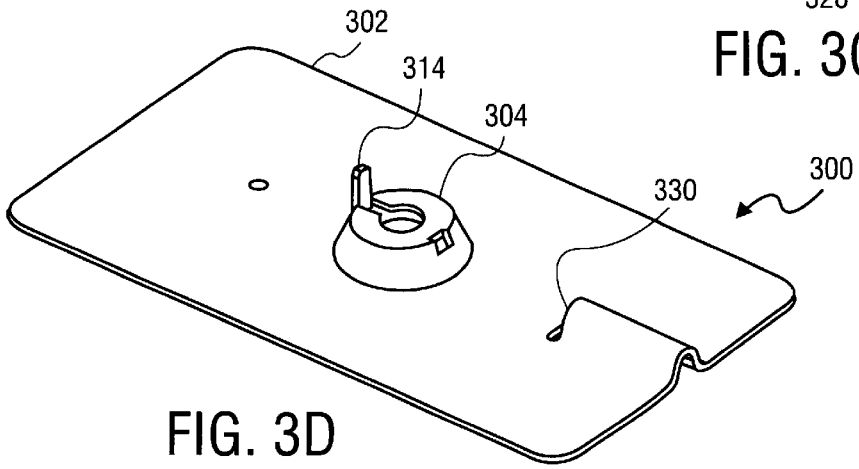
FIG. 3D illustrates an isometric view of plate 300.

FIG. 3A illustrates a top view of plate 300. Two of plate 300 may be used as plate 232 and plate 234 of FIG. 2. FIG. 3B illustrates a side sectional view of plate 300 generally taken off of line B—B of FIG. 3A. FIG. 3C illustrates a side view of plate 300 generally taken off of line C—C of FIG. 3A. FIG. 3D illustrates an isometric view of plate 300.

Included with plate 300 may be base 302 having boss 304, probe channel 306, and feed point 308 residing thereon. Base 302 may define interior surface 310 and exterior surface 312. As discussed more in connection with FIG. 4, base 302 may serve either as an antenna element or as a ground element in an antenna assembly of the invention.

Coining or boss 304 may include alignment tab 314, alignment slot 316, mounting hole 318, and mounting surface 320. Where two of plate 300 are used as plate 232 and plate 234 of FIG. 2, alignment tab 314 of plate 232 may fit within alignment slot 316 of an inverted plate 234 so as to align plate 232 with plate 234 as well as restrict the orientation of these two plates to a predetermined orientation. Mounting hole 318 may serve to receive a mounting device having a shaft (such as a rivet or screw 228 of FIG. 2). Mounting surface 320 may serve to elevate interior surface 310 from mounting surface 320 by height 322. Height 322 may represent one-half of the thickness of a dielectric layer.

Plate 300 may be made from any good conductor, such as steel, copper, or brass. Plate 300 may also be made from metal on a printed circuit board, where the material of the PC board also contributes as a dielectric. Each of alignment tab 314, alignment slot 316, mounting hole 318, and mounting surface 320 may be formed into base 302 so as to extend from interior surface 310. In one embodiment, each of alignment tab 314, alignment slot 316, mounting hole 318, and mounting surface 320 are stamped into base 302.

To minimize any interference to antenna operations caused by boss 304, maximum width 324 of boss 304 may be less than or equal to one third of width 326. In one embodiment, maximum width 324 of boss 304 is 0.39 inches (10.00 mm) and width 326 is 1.2 inches (30.48 mm).

Figure 4:
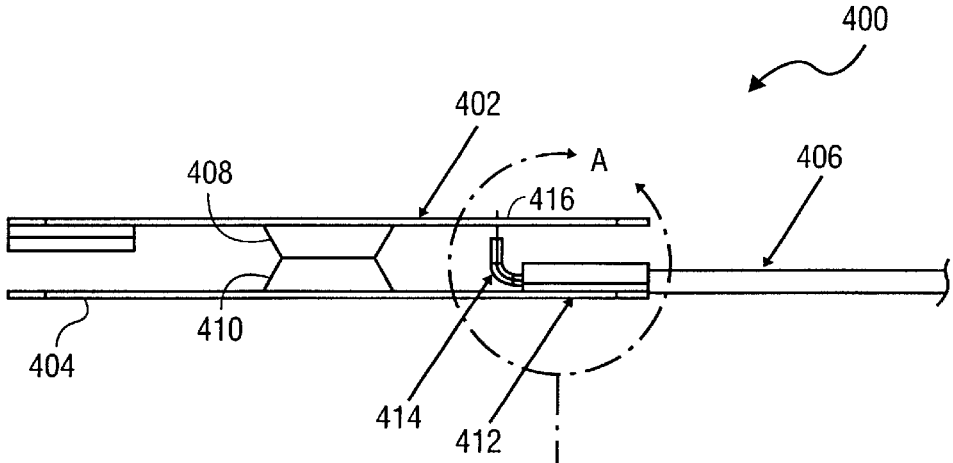
FIG. 4 illustrates antenna assembly 400 of the invention.
Figure 4A:
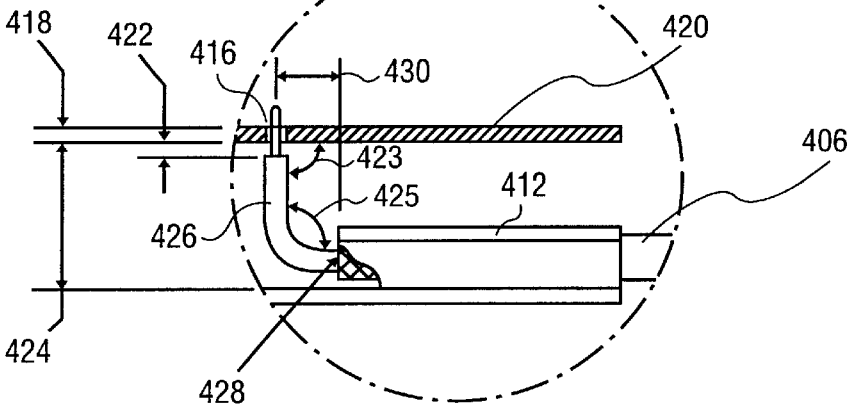
FIG. 4A is a detailed view of probe feed 406 placement into antenna assembly 400 generally taken off of line A of FIG. 4.

Probe channel 306 may include well 328 and opening 330. Well 328 may be shaped to act as a coupling location for probe feed 220 of FIG. 2. Moreover, opening 330 may permit probe feed 220 to extend beyond well 328 (as best seen in FIG. 4A).

Similar to boss 304, probe channel 306 may be stamped into base 302 so as to extend from interior surface 310. Where boss 304 and probe channel 306 extend from interior surface 310, exterior surface 312 may remain relatively flat to better serve as an antenna element or as a surface-mountable ground element. Particularly, probe channel 306 may permit coupling with a ground wire (shield) without a probe feed protruding into the internal mechanical structure on which exterior surface 312 may be supported.

Feed point 308 may be a hole that may receive an excitation wire from a transmission line probe feed, such as probe feed 220. It is this excitation wire that may cause plate 300 to generate radio waves. Accordingly, where probe feed 220 is coupled to feed point 308, base 302 may serve as an antenna element. This antenna element may direct incoming and outgoing radio waves between free space above exterior surface 312 and probe feed 220.

Directing incoming and outgoing radio waves may be a function of the frequency band at which an antenna element operates. In general, an antenna may be designed to communicate at specific frequencies. For example, in the United States, amplitude modulation (AM) radio broadcasting is done at frequencies between 535 and 1,605 kilohertz (kHz). At these frequencies, a wavelength of the radio waves is hundreds of meters or yards long. Controlling the length of such an antenna is expensive. Frequency modulation (FM) broadcasting on the other hand, is carried out at a range from 88 to 108 megahertz (MHz). At these frequencies, a typical radio wavelength is about three meters (ten feet) long. Here, the size of the antenna element can be economically adjusted precisely to the electromagnetic wave, both in transmitting and in receiving.

Cellular phones operate in the 824 to 894 MHz frequency band whereas Personal Communication Services (PCS) phones operate in the 1.85 to 1.99 gigahertz (GHz) frequency band. Wireless communications for computers may operate within the 2.4 to 2.5 GHz frequency band. In general, as the operating frequency increases, the radio wavelengths decrease so that more precision in the dimensions of the antenna element may be required to account for these shorter wavelengths.

The exterior profile of plate 300 may be defined by width 326 and length 332. Width 326 and, more persuasively, length 332 may affect the frequency band of radio waves that may be transmitted or received by plate 300 when acting as an antenna element. In other words, the operating frequency band of plate 300 will be dictated by length 332. Length 332 must be set in relation to the wavelength ($\lambda_0$) associated with a resonant frequency ($f_0$). When length 332 is set at ¼ ($\lambda_0$), plate 300 may be part of a quarter-wave patch antenna. When length 332 is set at ½ ($\lambda_0$), plate 300 may be part of a half-wave patch antenna.

At the cellular frequency band (824–894 MHz), length 332 of a quarter-wave patch antenna may be approximately 3.5 inches and length 332 of a half-wave patch antenna may be approximately 7.0 inches. These relatively long cellular patch antennas may be "folded" into a U, V, or L shape having two or more arms such as seen in U.S. Pat. No. 6,008,762. At the PCS frequency band (1.85–1.99 GHz), length 332 of a quarter-wave patch antenna may be approximately 1.5 inches and length 332 of a half-wave patch antenna may be approximately 3.0 inches. At the frequency band (2.4–2.5 GHz) (where computers or cordless phones may operate), length 332 of a quarter-wave patch antenna may be approximately 1.1 inches and length 332 of a half-wave patch antenna may be approximately 2.22 inches (56.39 millimeters (mm).).

When energy is transmitted to plate 300 through a probe feed coupled to feed point 308, this energy may set up a radio frequency (RF) field on plate 300 between ground (here mounting hole 318) and an edge of plate 300. At ground, there may be no opposition to current flow from the probe feed whereas at an edge of plate 300 there may be infinite resistance to current flow. Since most efficient radio frequency (RF) electronics employ a fifty ohm impedance, it may be important to position feed point 308 at a location on plate 300 where the impedance to current flow is near fifty ohms.

Width 326 may permit control over the spread of the RF field on plate 300. Width 326 may be in a range of one half to two times length 332. Where plate 300 contributes to a half-wave patch antenna operating at 2.4–2.5 GHz frequency band, length 332 may be 2.22 inches (56.39 mm) and width 326 may be 1.20 inches (30.48 mm)). With height 322 at 0.12 inches (3.00 mm) (making dielectric height 424 of FIG. 4A 0.24 inches (6.00 mm)), measurements have shown that length 334 for a fifty ohm impedance may be 0.528 inches (13.40 mm)) along the midpoint of width 326 for a 2.22×1.20 inch plate 300.

As noted above, two of plate 300 may be used as plate 232 and plate 234 of FIG. 2 so as to contribute to an antenna assembly. FIG. 4 illustrates antenna assembly 400 of the invention. Antenna assembly 400 may be employed in any wireless platform. Such wireless platforms may include mobile phones and accessories, network access devices, handheld computing devices, notebook personal computers (PCs), desktop PCs, audio/video equipment, printers, and electronic games. For example, antenna assembly 400 may be used as antenna assembly 230 of FIG. 2.

Antenna assembly 400 may include antenna plate 402, ground plate 404, and probe feed 406. Each of antenna plate 402 and ground plate 404 may be based on plate 300 of FIG. 3. These two plates may be assembled together by inverting antenna plate 402, bringing boss 408 against boss 410, and spot welding in place. Other attachment techniques, such as employing a nut-and-bolt system, are possible.

FIG. 4A is a detailed view of probe feed 406 placement into antenna assembly 400 generally taken off of line A of FIG. 4. Probe feed 406 may be placed into probe channel 412 where probe feed 406 may be secured into place, such as by soldering. That part of probe feed 406 extending towards boss 410 may then be angled over bend radius 414 and inserted into feed point 416.

Figure 5:
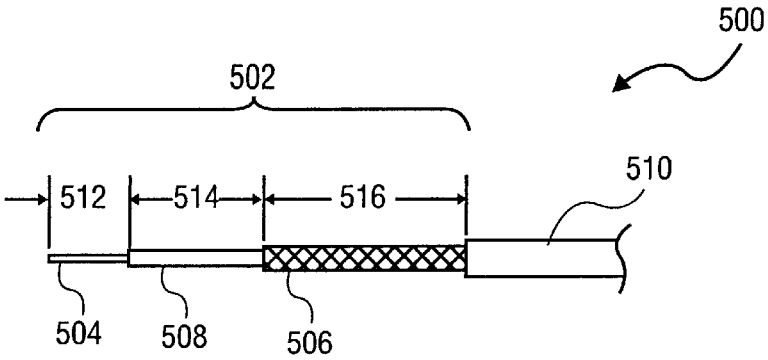
FIG. 5 illustrates probe feed 500 having antenna end 502.

Probe feed 406 may be based on probe feed 500 of FIG. 5. FIG. 5 illustrates probe feed 500 having antenna end 502. Probe feed 500 may be any structure having a conductor and a ground to transmit and receive signals. In one embodiment, probe feed 500 may be two wires that are independent of one another. These two wires may be a ground wire and a conductor wire. However, since the electromagnetic field associated with a coaxial cable may be confined to the spaces between an inner and outer conductor, probe feed 500 may be a coaxial cable. For example, probe feed 500 may be a fifty ohm characteristic impedance coax.

Included with probe feed 500 may be inner conductor 504 and outer conductor 506 as separated by dielectric 508. Inner conductor 504 may be use to pass signals as a center conductor of a coaxial cable. Outer conductor 506 may be a metal shield to act as a ground for that same coaxial cable. As a self-shielding, two conductor transmission line, outer conductor 506 may be concentric with and enclose inner conductor 504. Jacket 510 may be disposed about outer conductor 506 as an insulator.

To prepare probe feed 500, jacket 510, outer conductor 506, and dielectric 508 may be stripped from probe feed 500 to expose inner conductor 504 over length 512. Length 512 may be a function of thickness 418 of base 420 as well as gap 422.

It may be desirable to symmetrically radiate energy within antenna plate 402 as fed from probe feed 406. This symmetrically radiation of energy may best be achieved by placing a portion of probe feed 406 in perpendicular contact with antenna plate 402. Angle 423 may define the contact between antenna plate 402 and that portion of probe feed 406 that extends from base 420 towards ground plate 404 to an end of bend radius 414. In one embodiment, angle 423 is within the range of seventy to ninety degrees. In another embodiment, angle 423 is ninety degrees. The angle over which bend radius 414 may be formed may be defined as angle 425. Two contiguous segments of probe feed 406 may meet to define angle 425. In one embodiment, angle 425 may be within the range of seventy degrees to one hundred ten degrees. In another embodiment, angle 425 may be ninety degrees.

Coaxial cables may be made in three general types for different applications: flexible, semi-rigid, or rigid. Generally, coaxial cable is difficult to bend over a small radius, even in flexible applications. Where antenna plate 402 contributes to a half-wave patch antenna operating at 2.4–2.5 GHz frequency band, dielectric height 424 of FIG.

4A may be at 0.24 inches (6.00 mm). In a narrower band width application such as 2.40–2.41 GHz, dielectric height 424 may even be smaller. This tight space of 0.24 inches may require a small radius over which probe feed 400 is to be bent.

To aid in making this bend, probe feed 500 of the invention may further be prepared by stripping jacket 510 and outer conductor 506 from dielectric 508 over length 514. This in effect may decrease the radius over which probe feed 500 may be required to bend for a given dielectric height 424.

Stripping jacket 510 and outer conductor 506 from dielectric 508 over length 514 is distinguished from conventional methods. In conventional methods, the use of a coaxial cable connector dictates that the outer conductor of the connector be brought close to the feed point since the outer conductor serves as part of the connector used to attach the coaxial cable to the feed point. Although not preferred, the radius over which probe feed 406 may bend may further be reduced by scoring or removing portions of dielectric 426 that appear in bend radius 414 of FIG. 4A.

To provide access to outer connector 506, jacket 510 may be stripped from probe feed 500 to expose outer conductor 506 over length 516. Length 516 may be a function of the length of probe channel 412 of FIG. 4A. In this arrangement, the distance between an end of outer conductor 428 and feed point 416 (seen as length 430 of FIG. 4A) may be minimized. In one embodiment, length 430 is three to ten percent of length 332. In another embodiment, length 430 is four to five percent of length 332. In a further embodiment, length 430 is 0.098 inches (2.48 mm) where length 332 is 2.22 inches (56.39 mm).

An advantage of the invention is the range of structures to which antenna assembly 400 may be attached. For example, antenna assembly 400 may be mounted to surfaces that do not offer a natural ground plane. Examples of surfaces that do not offer a natural ground plane include the side brick wall of a building, a concrete wall, and a wooden post. Such uses may be possible since antenna assembly 400 may carry its own ground plate and may be mounted to a structure without the need to form a hole through the structure to route the probe feed.

Another advantage includes a direct coaxial cable connection since no connector is required for the feed. Moreover, a channel in the ground plate allows surface mounting without putting a hole through whatever the antenna may be mounted. Further, a center boss and symmetrical plates greatly improve ease of fabrication.

The exemplary embodiments described herein are provided merely to illustrate the principles of the invention and should not be construed as limiting the scope of the subject matter of the terms of the claimed invention. The specification and drawings are, accordingly, to be regarded in an illustrative rather than a restrictive sense. Moreover, the principles of the invention may be applied to achieve the advantages described herein and to achieve other advantages or to satisfy other objectives, as well.

What is claimed is:

1. An antenna assembly comprising:

an antenna plate that defines an interior surface, the antenna plate having a boss that extends from the interior surface of the antenna plate and a feed point;

a ground plate that defines an interior surface, the ground plate having a probe channel and a boss wherein each extends from the interior surface of the ground plate, and wherein the ground plate boss is coupled to the antenna plate boss; and a probe feed having a ground wire coupled to the probe channel and a conductor wire coupled to the feed point.

2. The antenna assembly of claim 1 wherein the antenna plate further includes a probe channel that extends from the interior surface of the antenna plate and wherein the ground plate further includes a feed point.

3. The antenna assembly of claim 2 wherein the boss of the antenna plate further includes a mounting hole disposed between a tab and a slot and wherein the boss of the ground plate further includes a mounting hole disposed between a tab and a slot.

4. The antenna assembly of claim 3 wherein the conductor wire is disposed concentric to the ground wire as part of a coaxial cable.

5. The antenna assembly of claim 1 wherein the feed point is a hole disposed through the antenna plate.

6. The antenna assembly of claim 1 wherein each of the antenna plate and the boss of the antenna plate defines a width and wherein the width of the antenna plate boss is less than or equal to one third of the width of the antenna plate.

7. The antenna assembly of claim 1 wherein a dielectric is concentrically disposed between the ground wire and the conductor wire and wherein the conductor wire is removed from the dielectric over a length.

8. The antenna assembly of claim 7 wherein the conductor wire includes a first segment and a second segment, wherein the first segment is coupled to the antenna plate to define a first angle that is within zero to twenty degrees perpendicularity of a plane of the antenna plate.

9. The antenna assembly of claim 8 wherein the second segment defines a second axis that forms a second angle with the first axis of the first segment that is within seventy degrees to one hundred ten degrees.

10. The antenna assembly of claim 9 wherein the second angle is ninety degrees.

11. The antenna assembly of claim 1, wherein said ground plate further defines an exterior surface and wherein said exterior surface is surface-mountable.

12. The antenna assembly of claim 1, wherein said antenna plate further defines an exterior surface and wherein said exterior surface is surface-mountable.

13. The antenna assembly of claim 1, wherein said antenna plate is fabricated from sheet metal and wherein said ground plate is fabricated from sheet metal.

14. An antenna system comprising:

a chassis;

an antenna assembly coupled to the chassis and having an antenna plate, a ground plate, and a probe feed, wherein the antenna plate defines an interior surface, the antenna plate having a boss that extends from the interior surface of the antenna plate and a feed point, wherein the ground plate defines an interior surface, the ground plate having a probe channel and a boss wherein each extends from the interior surface of the ground plate, wherein the ground plate boss is coupled to the antenna plate boss, wherein the probe feed includes a ground wire coupled to the probe channel and a conductor wire coupled to the feed point, and wherein the probe feed does not protrude into the chassis;

a wireless card coupled to the probe feed;

a chipset coupled to the wireless card; and a central processing unit coupled to the chipset.

15. The antenna assembly of claim 14 wherein the antenna plate further includes a probe channel that extends from the interior surface of the antenna plate and wherein the ground plate further includes a feed point.

16. The antenna system of claim 15 wherein the boss of the antenna plate further includes a mounting hole disposed between a tab and a slot, wherein the boss of the ground plate further includes a mounting hole disposed between a tab and a slot, the antenna system further comprising:

a screw disposed through each boss hole and into the chassis.

17. The antenna system of claim 14 wherein each of the antenna plate and the boss of the antenna plate defines a width and wherein the width of the antenna plate boss is less than or equal to one third of the width of the antenna plate.

18. The antenna system of claim 14 wherein a dielectric is concentrically disposed between the ground wire and the conductor wire and wherein the conductor wire is removed from the dielectric over a length.

19. The antenna system of claim 18 wherein the conductor wire includes a first segment and a second segment, wherein the first segment is coupled to the antenna plate to define a first angle that is within zero to twenty degrees perpendicularity of a plane of the antenna plate.

20. The antenna system of claim 19 wherein the second segment defines a second axis that forms a second angle with the first axis of the first segment that is within seventy degrees to one hundred ten degrees.

21. The antenna system of claim 14, wherein said ground plate further defines an exterior surface, wherein the exterior surface of the ground plate is surface-mountable, and wherein the ground plate is fabricated from sheet metal.

22. The antenna system of claim 14, wherein said antenna plate further defines an exterior surface, wherein the exterior surface of the antenna plate is surface-mountable, and wherein the antenna plate is fabricated from sheet metal.

23. An antenna plate comprising:

a base that defines an interior surface;

a boss that extends from the interior surface of the base, the boss including a mounting hole disposed between a tab and a slot;

a feed point disposed through the base; and a probe channel that extends from the interior surface of the base.

24. The antenna plate of claim 23 wherein each of the base and the boss defines a width and wherein the width of the boss is less than or equal to one third of the width of the base.

25. An antenna plate comprising:

a base that defines an interior surface;

a boss that extends from the interior surface of the base;

a feed point disposed through the base;

a probe channel that extends from the interior surface of the base; and wherein said antenna plate is fabricated from sheet metal.

26. An antenna plate comprising:

a base that defines an interior surface;

a boss that extends from the interior surface of the base;

a feed point disposed through the base;

a probe channel that extends from the interior surface of the base; and an exterior surface, said exterior surface being surface-mountable.

27. An antenna assembly comprising:

a. a ground plate defining an interior surface and an exterior surface, said ground plate having a boss that extends from the interior surface of the ground plate and wherein the exterior surface of the ground plate is surface-mountable;

b. an antenna plate defining an interior surface, the antenna plate having a boss that extends from the interior surface of the antenna plate and wherein the antenna plate boss is coupled to the ground plate boss; and c. a probe feed having a ground wire coupled to the ground plate and a conductor wire coupled to the antenna plate.

28. The antenna assembly of claim 27, wherein said antenna plate further defines an exterior surface and wherein the exterior surface of the antenna plate is surface-mountable.

29. The antenna assembly of claim 27, wherein said antenna plate is fabricated from sheet metal and wherein said ground plate is fabricated from sheet metal.

30. The antenna assembly of claim 27, wherein said probe feed having a ground wire coupled to the ground plate and a conductor wire coupled to the antenna plate, wherein the couplings do not use connectors.

31. The antenna assembly of claim 27, wherein said ground plate further comprises a probe channel that extends from the interior surface of the ground plate and wherein said antenna plate further comprises a feed point.

32. The antenna assembly of claim 31, wherein said ground wire of the probe feed is coupled to the probe channel of the ground plate and said conductor wire of the probe feed is coupled to the feed point of the antenna plate.

33. The antenna assembly of claim 27, wherein said antenna plate further comprises a probe channel that extends from the interior surface of the antenna plate and wherein said ground plate further comprises a feed point.

34. An antenna plate comprising:

a base defining an interior surface and an exterior surface, said exterior surface is surface-mountable;

a boss that extends from the interior surface of the base;

a feed point disposed through the base; and a probe channel that extends from the interior surface of the base.

* * * * *